US010273971B2

(12) United States Patent
Xu et al.

(10) Patent No.: US 10,273,971 B2
(45) Date of Patent: Apr. 30, 2019

(54) FAN IMPELLER STRUCTURE OF COOLING FAN

(71) Applicant: ASIA VITAL COMPONENTS CO., LTD., New Taipei (TW)

(72) Inventors: Liang-Hua Xu, New Taipei (TW); Te-Chung Wang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 445 days.

(21) Appl. No.: 15/063,518

(22) Filed: Mar. 8, 2016

(65) Prior Publication Data

US 2017/0260994 A1 Sep. 14, 2017

(51) Int. Cl.
*F04D 29/28* (2006.01)
*F04D 25/08* (2006.01)
*F04D 29/62* (2006.01)

(52) U.S. Cl.
CPC ..... *F04D 29/281* (2013.01); *F04D 25/08* (2013.01); *F04D 29/624* (2013.01)

(58) Field of Classification Search
CPC .... F04D 29/281; F04D 29/624; F04D 29/388; F04D 29/34; F04D 25/08; F04D 19/002
See application file for complete search history.

(56) References Cited

U.S. PATENT DOCUMENTS 5,487,639 A * 1/1996 Asabuki ..... F04D 23/008 415/55.1
5,655,882 A * 8/1997 Morgan ..... F04D 29/329 416/204 R
6,302,650 B1 * 10/2001 Williams ..... B29C 45/2708 416/144
6,358,009 B1 * 3/2002 Link ..... F04D 29/662 416/145
7,097,430 B2 * 8/2006 Harris ..... B29C 45/14065 264/45.3
8,807,939 B2 * 8/2014 Gardas ..... F04D 29/646 416/147
9,523,372 B2 * 12/2016 Stagg ..... B29C 45/14336

* cited by examiner

*Primary Examiner* — Dwayne J White
*Assistant Examiner* — Adam W Brown
(74) *Attorney, Agent, or Firm* — Jackson IPG PLLC; Demian K. Jackson

(57) ABSTRACT

A fan impeller structure of cooling fan includes a blade assembly and a hub. The blade assembly has multiple blades and an annular cover body. The annular cover body is integrally formed on the rear ends of the blades by injection molding to enclose and connect with the rear ends of the blades. Alternatively, the annular cover body is fused and integrally connected with the rear ends of the blades by means of laser welding. The blade assembly and the hub are integrally connected with each other to form the fan impeller structure.

9 Claims, 13 Drawing Sheets

FAN IMPELLER STRUCTURE OF COOLING FAN

BACKGROUND OF THE INVENTION

1. Field of the Invention

The present invention relates generally to a heat dissipation component, and more particularly to a fan impeller structure of cooling fan.

2. Description of the Related Art

A cooling fan is an often seen component of an electronic product in heat dissipation field. The cooling is often made of metal or plastic material. In the case that the blades are made of plastic material by means of injection molding, the blades have a certain thickness generally larger than 0.3 mm. Due to the properties of plastic material, the blades cannot be too thin. Otherwise, in rotation, the blades will be unable to bear the wind resistance and may break apart. Currently, it is a critical issue in this field how to reduce the thickness of the blades and manufacture ultrathin blades with required strength. Also, it is a critical issue how to more securely connect the ultrathin blades with the hub of the cooling fan.

SUMMARY OF THE INVENTION

It is therefore a primary object of the present invention to provide a fan impeller structure of cooling fan. The fan impeller structure includes a blade assembly and a hub. The blade assembly has multiple ultrathin blades and an annular cover body. The annular cover body is integrally connected with the blades to enhance the fixing strength of the blades.

It is a further object of the present invention to provide the above fan impeller structure of cooling fan. The blades of the blade assembly are not directly connected with the hub, but connected with the hub via the annular cover body. The multiple blades are secured along the circumference of the hub. This improves the problem of the conventional fan impeller that the blades are directly welded on the hub or engaged with the hub and the connected parts are apt to break.

To achieve the above and other objects, the fan impeller structure of cooling fan of the present invention includes a blade assembly and a hub. The blade assembly has multiple blades and an annular cover body. Each blade has a front end and a rear end. The annular cover body is integrally formed on the rear ends of the blades by injection molding to enclose and connect with the rear ends of the blades. The annular cover body is formed with multiple assembling sections disposed on one side of the annular cover body. The hub has a flange section, multiple perforations, a top wall and a circumferential wall outward extending from a circumference of the top wall. The flange section outward extends from the circumferential wall. The flange section is correspondingly connected with the annular cover body. The perforations are formed through the flange section and integrally connected with the corresponding assembling sections.

Alternatively, the fan impeller structure of cooling fan of the present invention includes a blade assembly and a hub. The blade assembly has multiple blades and an annular cover body. Each blade has a front end and a rear end. The annular cover body has multiple insertion slits and multiple assembling sections. The insertion slits are formed on an outer circumference of the annular cover body. The rear ends of the blades are inserted and connected in the corresponding insertion slits. Multiple fusion sections are formed between the rear ends of the blades and contact sections of one side of the annular cover body in adjacency to the insertion slits. The assembling sections are formed on one side of the annular cover body in adjacency to the insertion slits. The hub has a flange section, multiple perforations, a top wall and a circumferential wall outward extending from a circumference of the top wall. The flange section outward extends from the circumferential wall. The flange section is correspondingly connected with the annular cover body. The perforations are formed through the flange section and integrally connected with the corresponding assembling sections.

In the above fan impeller structure of cooling fan, the annular cover body has multiple notches, a top side and a bottom side. The notches are formed on the bottom side of the annular cover body and arranged at intervals. The rear ends of the blades are positioned between the notches. The assembling sections are formed on the bottom side of the annular cover body of the annular cover body along an inner circumference of the annular cover body in alignment with the notches.

In the above fan impeller structure of cooling fan, the annular cover body has multiple enclosure sections integrally formed with the annular cover body. Each enclosure section is positioned between each two adjacent notches. Each blade has at least one opening formed through the rear end of the blade. The enclosure sections are integrally formed on two sides of the rear ends of the blades and in the openings to enclose the rear ends of the blades.

In the above fan impeller structure of cooling fan, the flange section is formed with multiple recesses. The recesses are arranged along an outer circumference of the flange section. A protruding tooth is defined between each two adjacent recesses. The protruding teeth are inserted in the corresponding notches of the annular cover body. The enclosure sections are received in the recesses.

In the above fan impeller structure of cooling fan, the assembling sections are connected in the perforations by means of riveting, screwing (or connection) or press fit (or connection).

In the above fan impeller structure of cooling fan, the annular cover body has multiple notches, a top side, a bottom side and multiple raised sections. The notches are formed on the bottom side of the annular cover body and arranged at intervals. The insertion slits are positioned between the notches. The assembling sections are formed on the bottom side of the annular cover body along an inner circumference of the annular cover body in alignment with the notches. The raised sections upward protrude from two sides of each adjacent insertion slit. The raised sections are positioned between each two adjacent notches.

In the above fan impeller structure of cooling fan, the rear end of the blade and the contact section of the annular cover body in adjacency to the insertion slit are fused and connected with each other by means of laser processing to form the fusion section.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
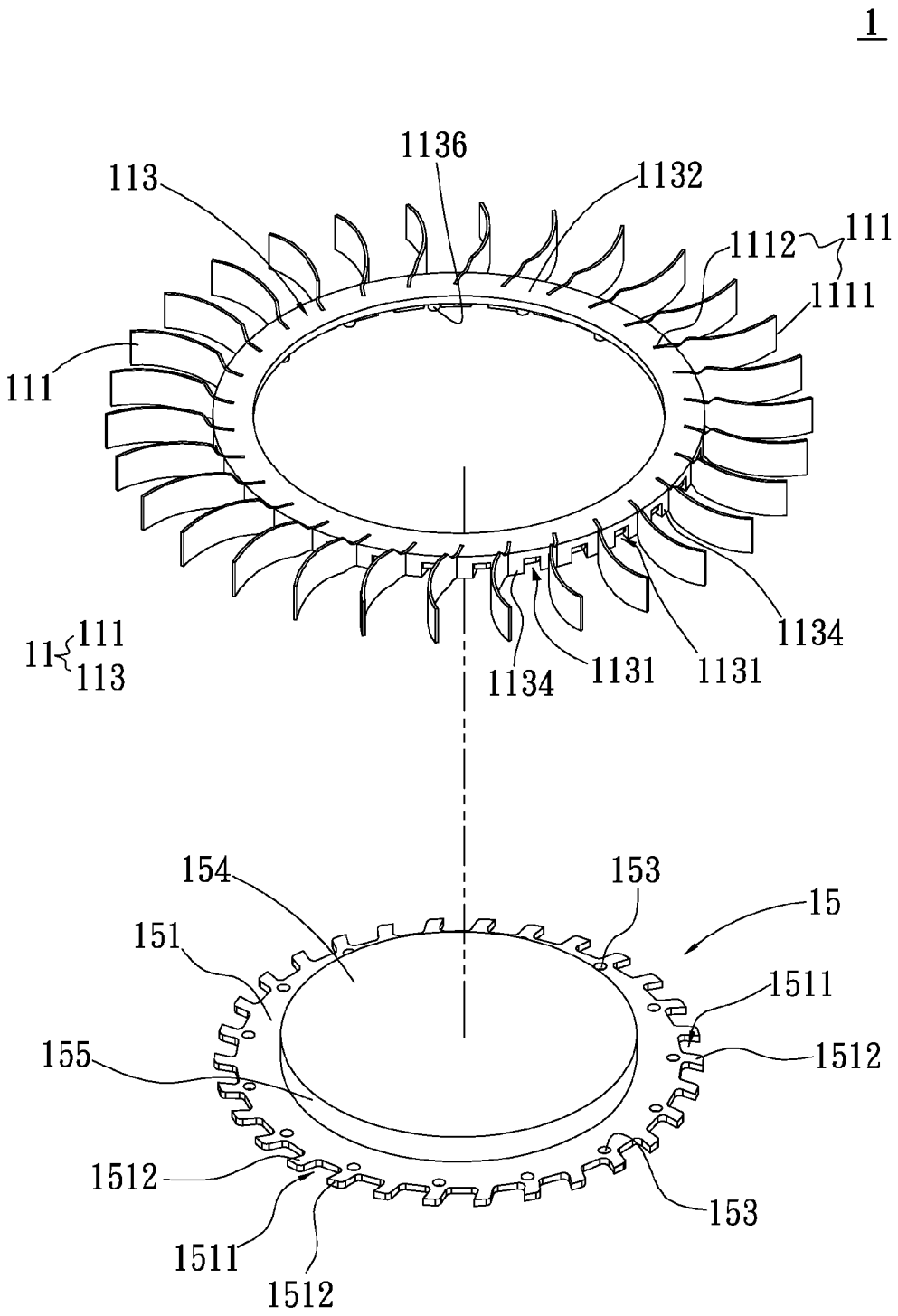
FIG. 1A is a perspective exploded view of a first embodiment of the present invention.
Figure 1B:
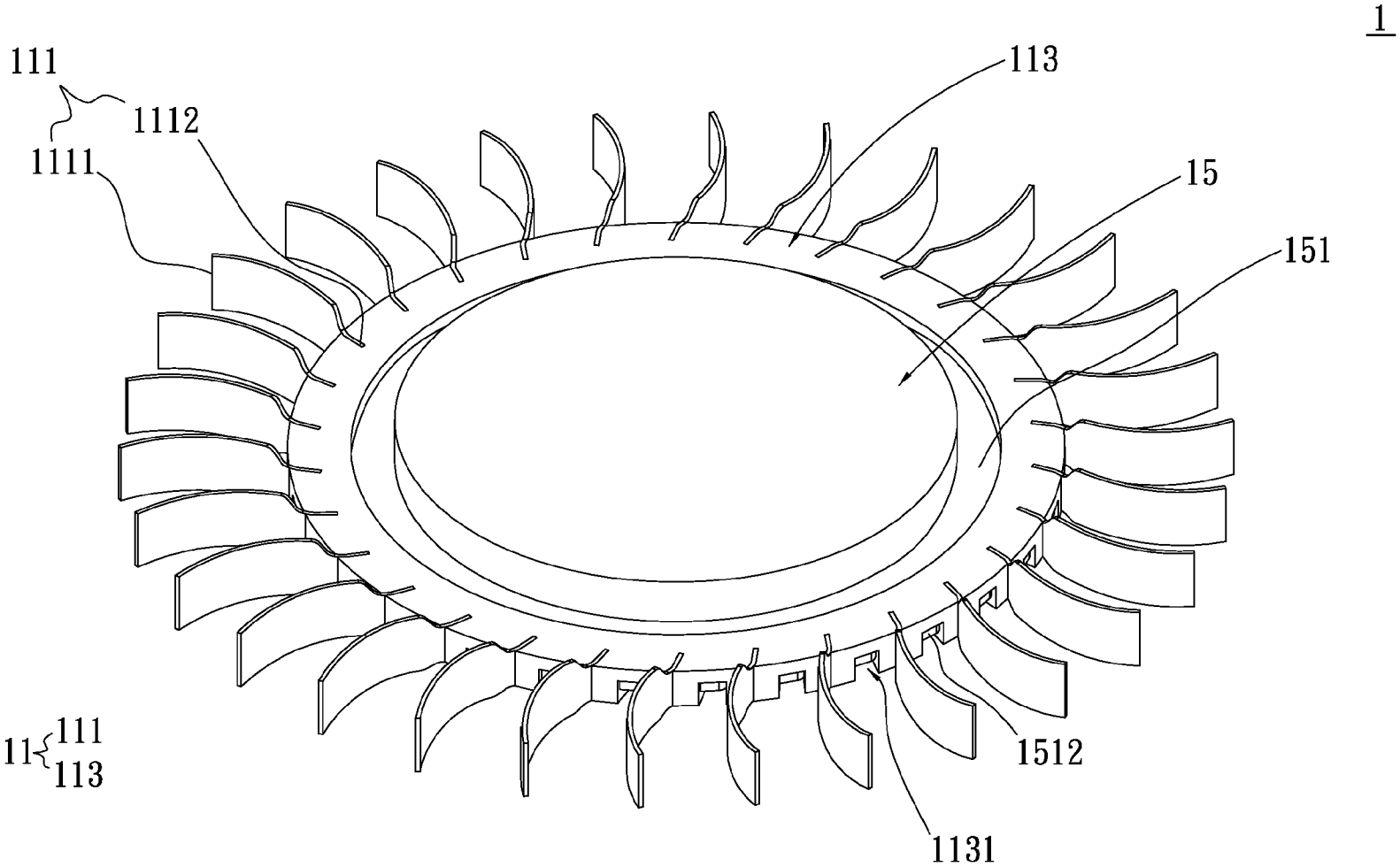
FIG. 1B is a perspective assembled view of the first embodiment of the present invention.
Figure 3:
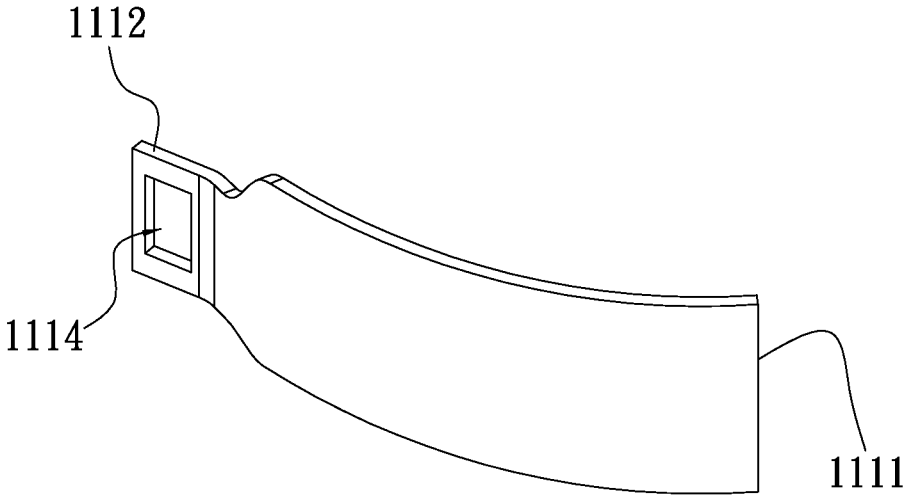
FIG. 3 is a perspective view of the blade of the first embodiment of the present invention.

Please refer to FIGS. 1A and 1B and also supplementally refer to FIG. 3. FIG. 1A is a perspective exploded view of a first embodiment of the present invention. FIG. 1B is a perspective assembled view of the first embodiment of the present invention. FIG. 3 is a perspective view of the blade of the first embodiment of the present invention. The present invention provides a fan impeller structure of cooling fan. In this embodiment, the cooling fan is such as a centrifugal fan (not shown). The fan impeller structure 1 includes a blade assembly 11 and a hub 15. The blade assembly 11 has multiple blades 111 and an annular cover body 113. The blades 111 can be made of metal material with ductility and malleability and good strength, such as, but not limited to, aluminum, aluminum alloy, steel, iron or titanium alloy material. Each blade 111 has a front end 1111, a rear end 1112 and at least one opening 1114. The opening 1114 is formed through the rear end 1112 of the blade 111 for enhancing the connection strength between the blade 111 and the annular cover body 113.

Figure 2:
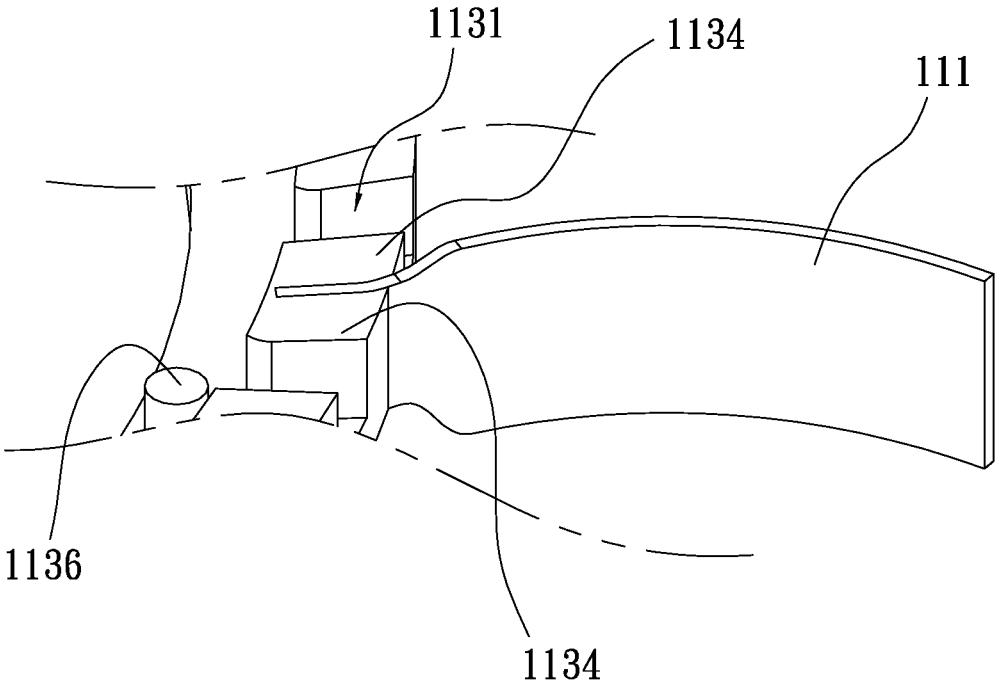
FIG. 2 is a perspective view showing that the blade of the first embodiment is integrally enclosed in the enclosure section.

The annular cover body 113 is integrally formed on the rear ends 1112 of the blades 111 by injection molding to enclose and connect with the rear ends 1112 of the blades 111 (as shown in FIG. 2). That is, when the annular cover body 113 is injection molded in the mold, the rear ends 1112 of the blades 111 are integrally enclosed in the annular cover body 113. Accordingly, the annular cover body 113 is integrally connected with the blades 111. Under such circumstance, when the hub 15 operates, the blades 111 of the blade assembly 11 are prevented from being thrown out due to the centrifugal force. In addition, the blades 111 are made of metal material by means of pressing. The blades 111 are ultrathin blades with a thickness preferably smaller than 0.15 mm (so that the number of the blades 111 can be increased). The hub 15 can be made of metal material by means of pressing. The annular cover body 113 is made of plastic material by means of injection molding.

Figure 1C:
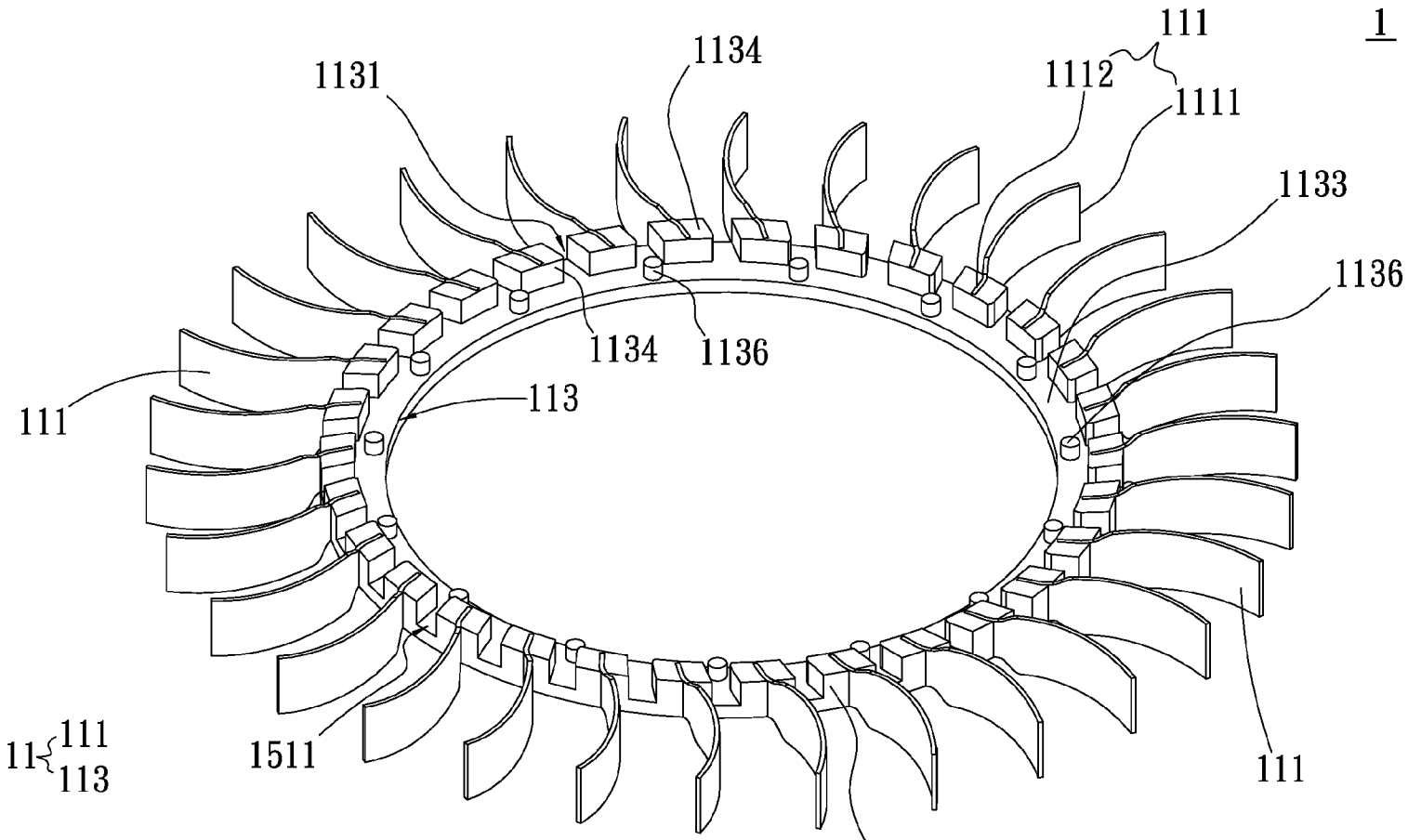
FIG. 1C is a perspective view of the blade assembly of the first embodiment of the present invention, seen from another angle.
Figure 4A:
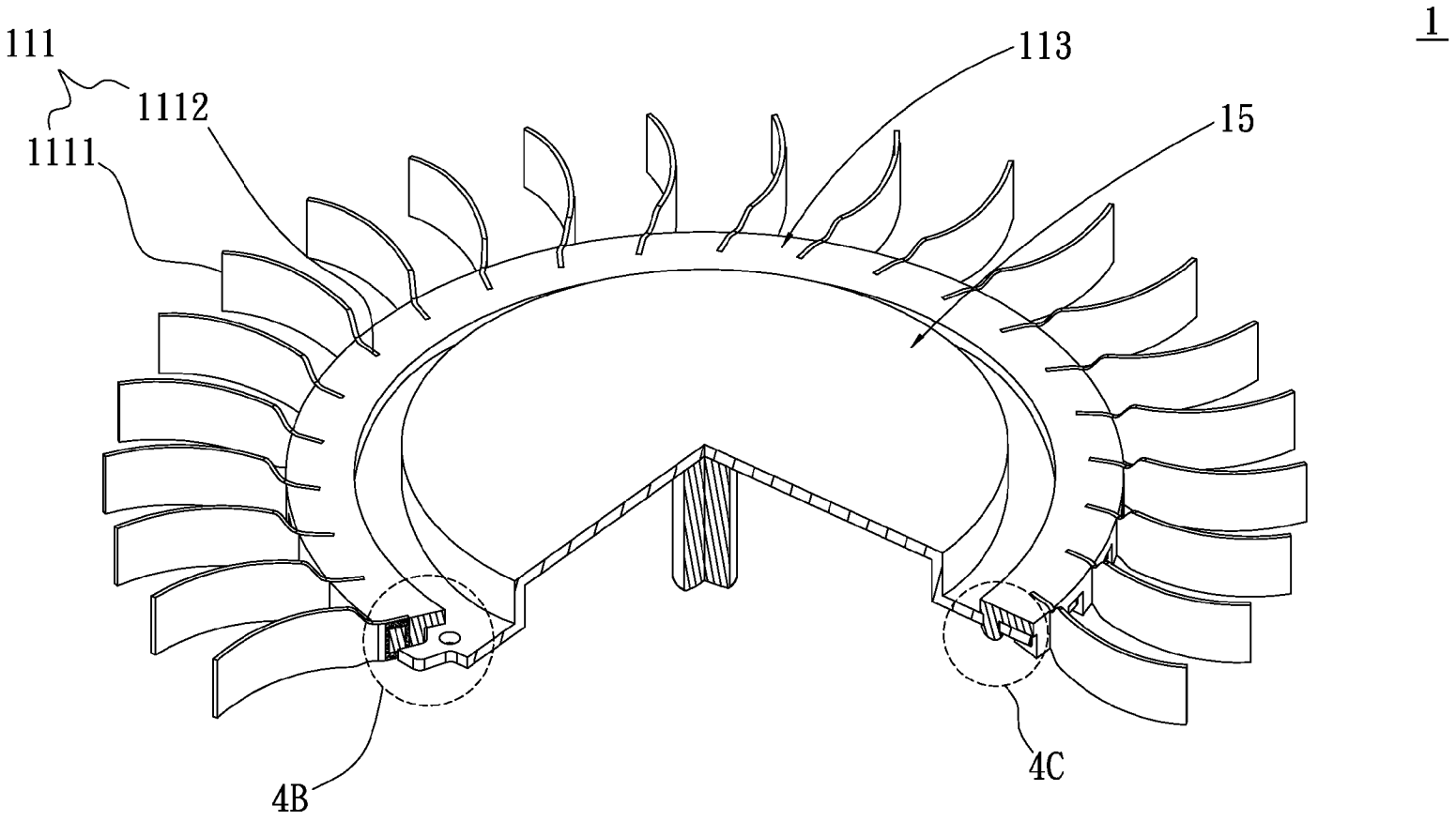
FIG. 4A is a perspective partially sectional view of the first embodiment of the fan impeller of the present invention.
Figure 4B:
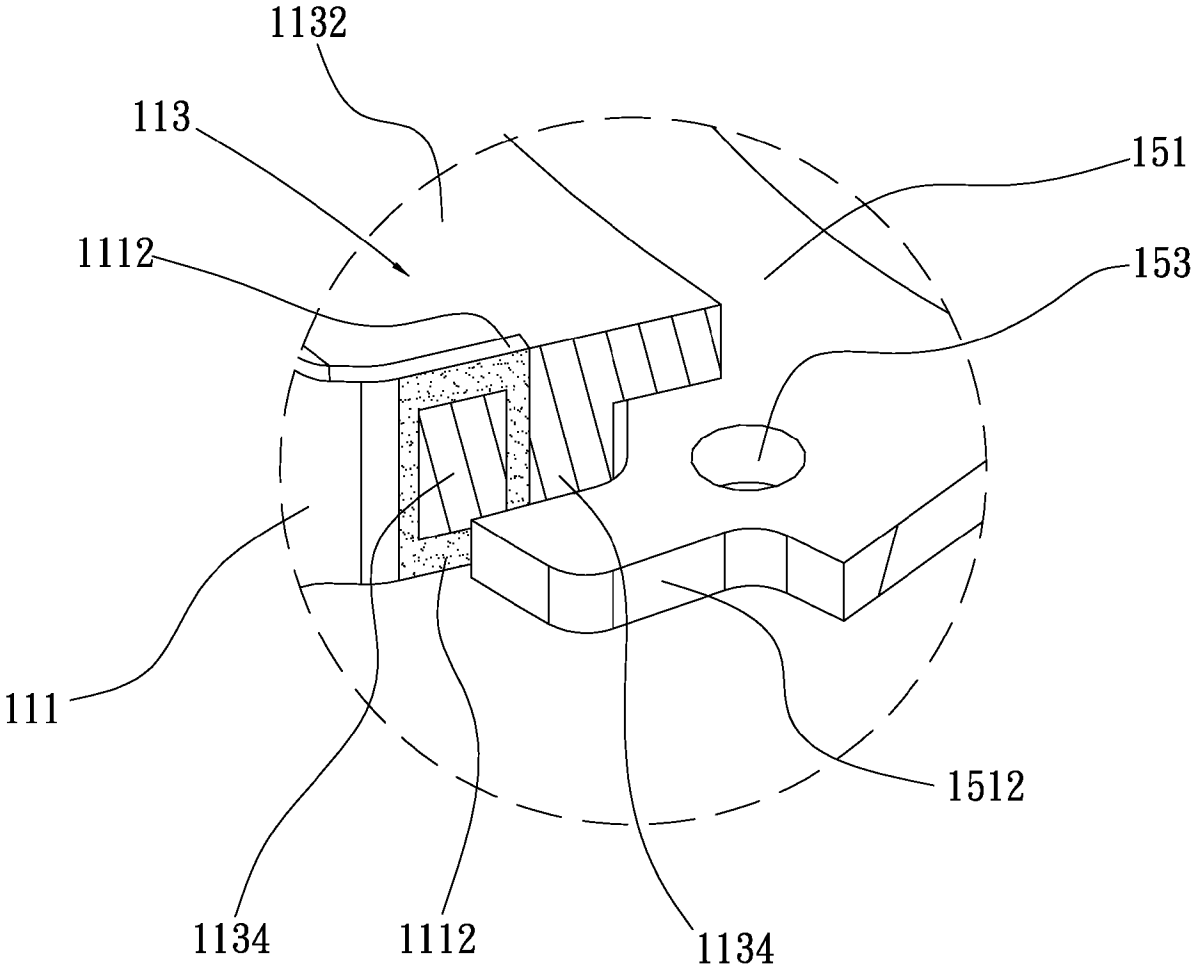
FIG. 4B is an enlarged view of circled area 4B of FIG. 4A.

Please further refer to FIGS. 1A, 1C and 4A. The annular cover body 113 is formed with multiple assembling sections 1136, multiple enclosure sections 1134, multiple notches 1131, a top side 1132 and a bottom side 1133. The notches 1131 are formed on the bottom side 1133 of the annular cover body 113 and arranged at intervals. The rear ends 1112 of the blades 111 are positioned between the notches 1131. The assembling sections 1136 are formed on one side of the annular cover body 113. In this embodiment, the assembling sections 1136 are formed on the bottom side 1133 of the annular cover body 113 along the inner circumference of the annular cover body 113 in alignment with the notches 1131. Each assembling section 1136 is a rivet column. In practice, the assembling section 1136 can be alternatively a bolt or a boss. The enclosure sections 1134 are parts of the annular cover body 113. The enclosure sections 1134 are integrally formed with the annular cover body 113 by plastic injection molding. The enclosure sections 1134 are integrally formed on two sides of the rear ends 1112 of the blades 111 and in the openings 1114 to enclose the rear ends 1112 (as shown in FIGS. 4A and 4B). Each enclosure section 1134 is positioned between each two adjacent notches 1131.

Figure 4C:
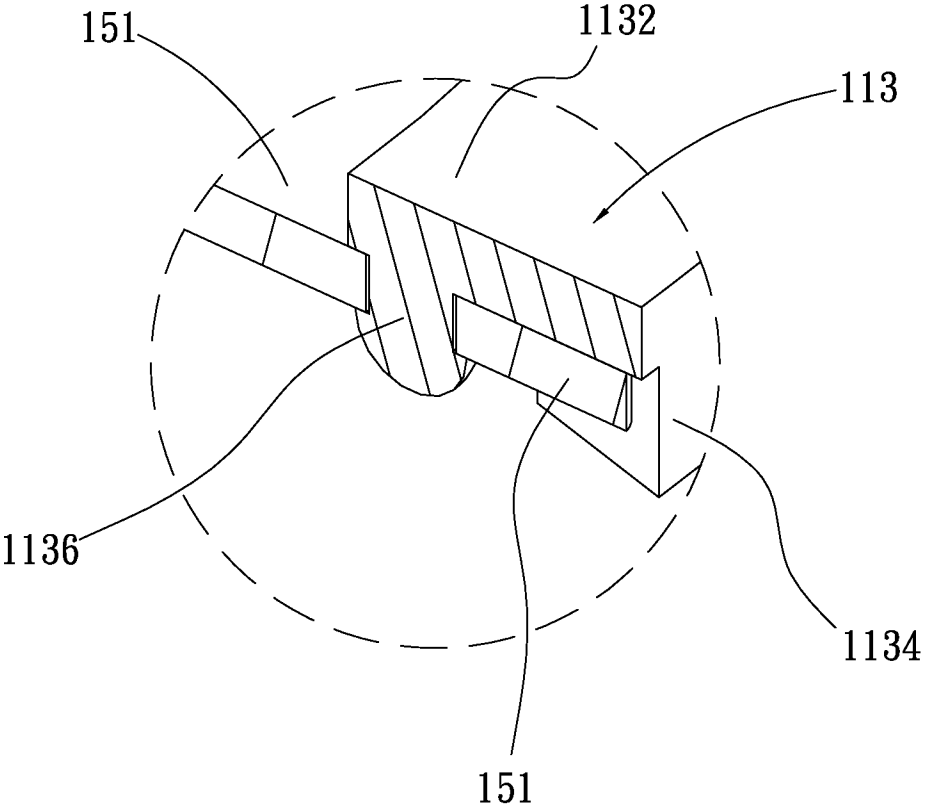
FIG. 4C is an enlarged view of circled area 4C of FIG. 4A.

The hub 15 has a flange section 151, multiple perforations 153, a top wall 154 and a circumferential wall 155 downward extending from the circumference of the top wall 154. The flange section 151 outward extends from the circumferential wall 155. In this embodiment, the flange section 151 horizontally outward extends from the outer circumference of the bottom end of the circumferential wall 155. The flange section 151 is connected with the annular cover body 113. The flange section 151 is formed with multiple recesses 1511. The recesses 1511 are arranged along the outer circumference of the flange section 151. A protruding tooth 1512 is defined between each two adjacent recesses 1511. The protruding teeth 1512 are inserted in the notches 1131 of the annular cover body 113. The enclosure sections 1134 are received and connected in the recesses 1511. The perforations 153 are formed through the flange section 151. The assembling sections 1136 are correspondingly integrally connected in the perforations 153. In this embodiment, the perforations 153 are rivet holes. In practice, the perforations 153 can be alternatively threaded holes or insertion holes. The assembling sections 1136 are passed through the corresponding perforations 153 and then securely riveted on the flange section 151 by means of heat staking or cold staking (as shown in FIGS. 4A and 4C). Accordingly, the blade assembly 11 and the hub 15 are integrally connected with each other to form the fan impeller structure 1. In a modified embodiment, the assembling sections 1136 are connected in the perforations 153 by means of screwing (or connection) or press fit (or connection).

According to the above arrangement, the thinner blades 111 of the present invention are integrally enclosed in the enclosure sections 1134 of the annular cover body 113. The blade assembly 11 and the hub 15 are integrally connected with each other to form the fan impeller structure 1. The blades 111 are fixedly positioned around the hub 15 and the connection strength between the blades 111 and the hub 15 is enhanced. This improves the problem of the conventional fan impeller that the blades are directly welded on the hub or engaged with the hub and the connected parts are apt to break.

Figure 5A:
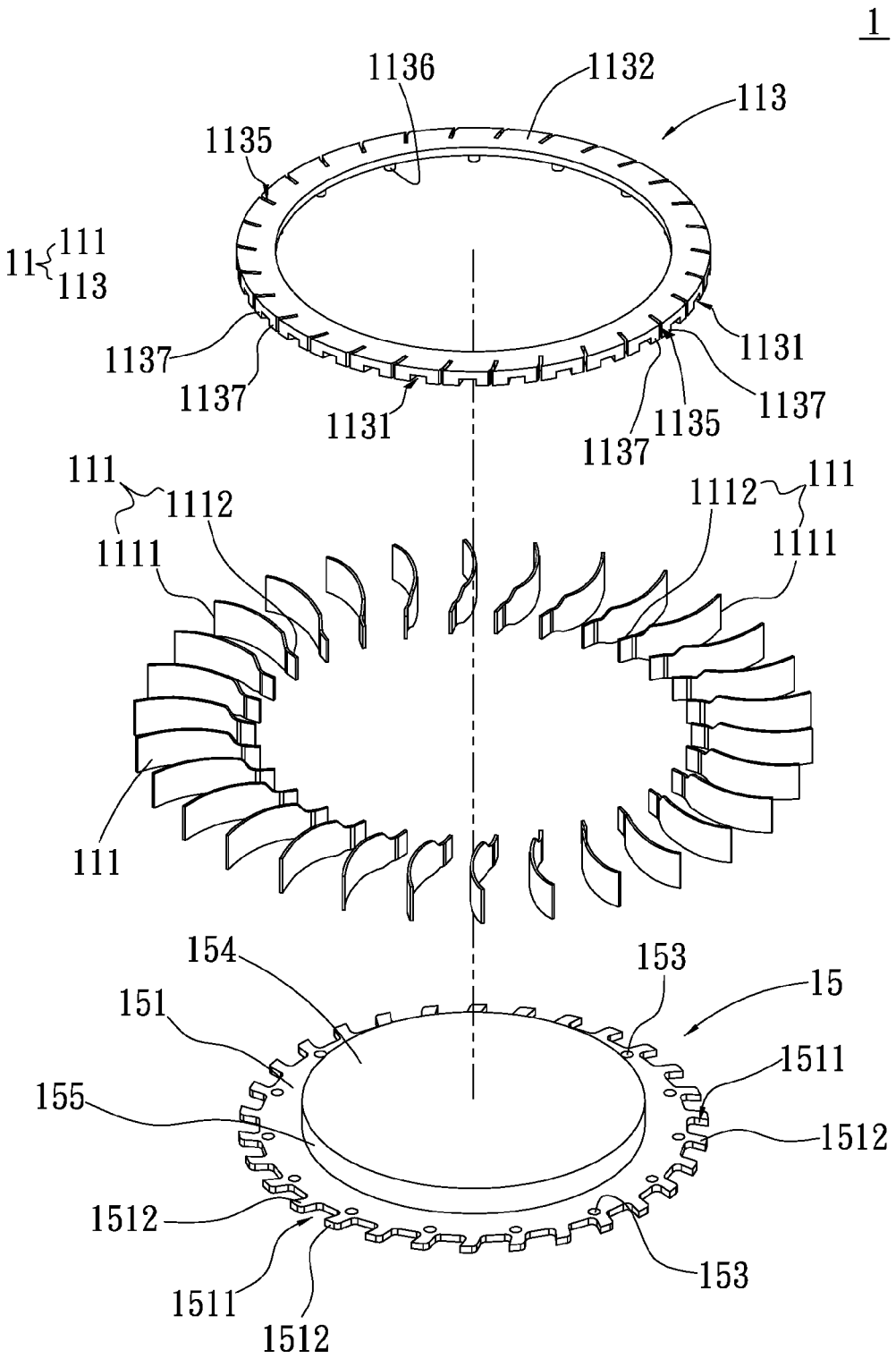
FIG. 5A is a perspective exploded view of a second embodiment of the present invention.
Figure 5B:
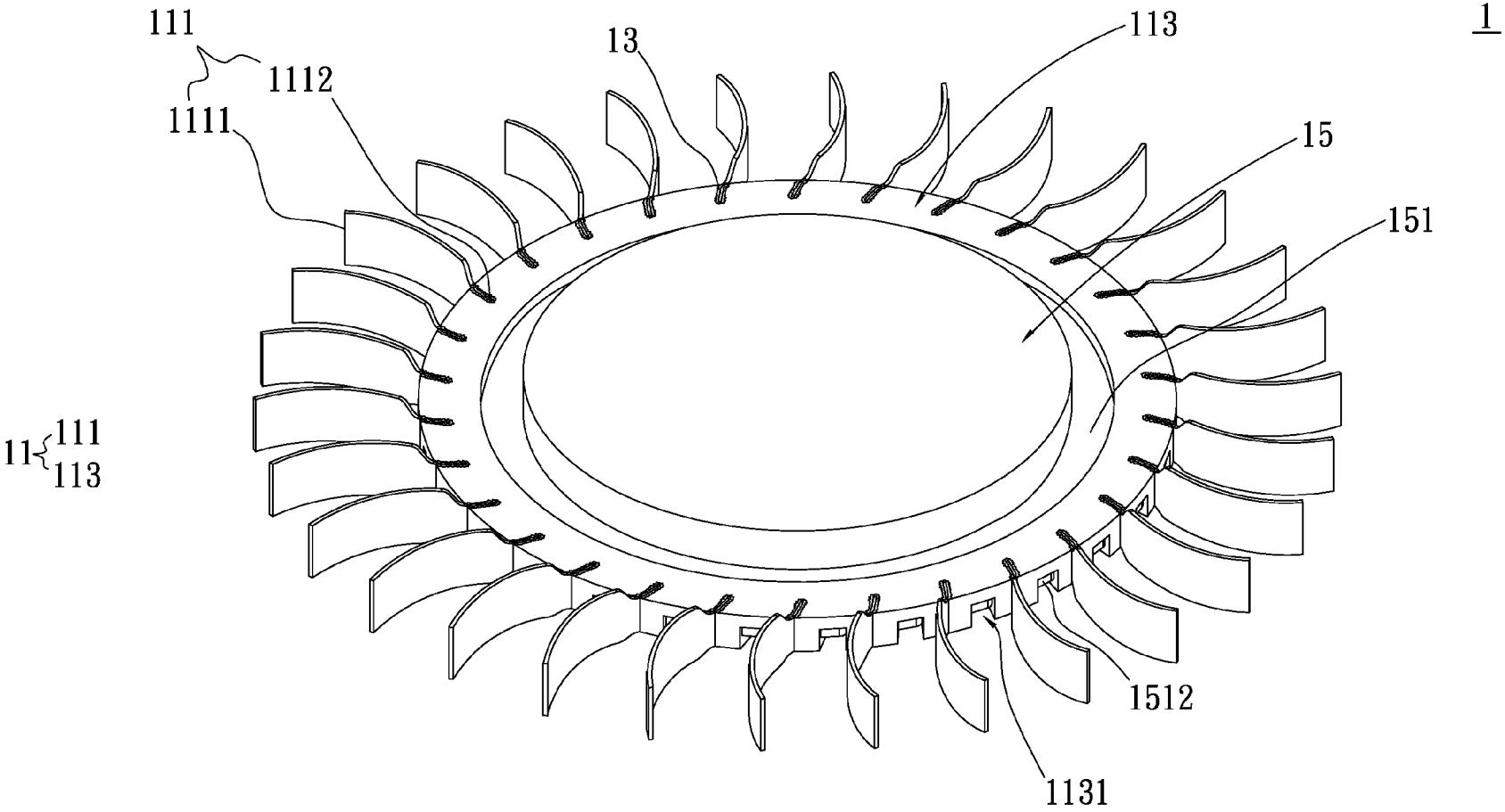
FIG. 5B is a perspective assembled view of the second embodiment of the present invention.
Figure 5C:
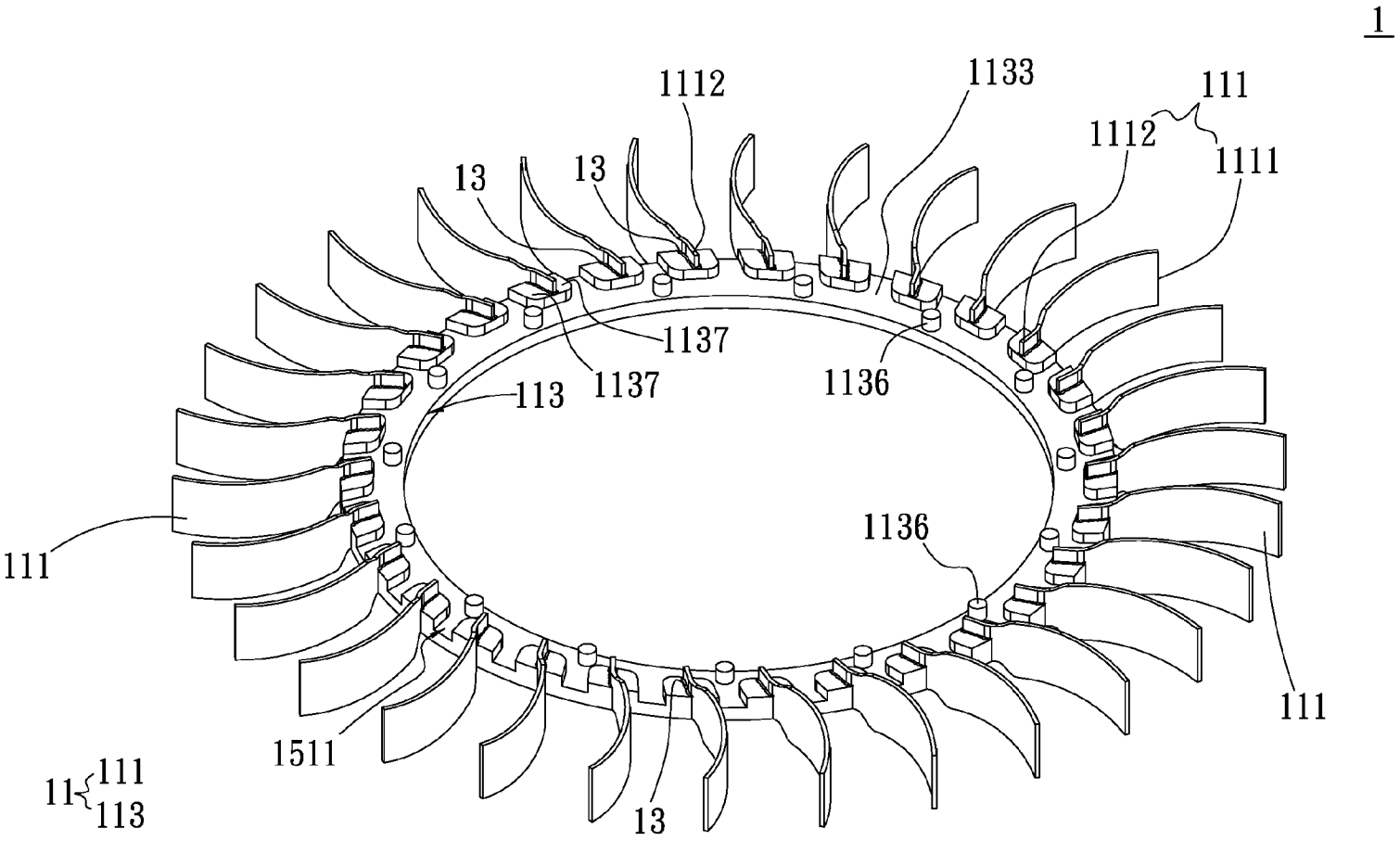
FIG. 5C is a perspective view of the blade assembly of the second embodiment of the present invention, seen from another angle.
Figure 6A:
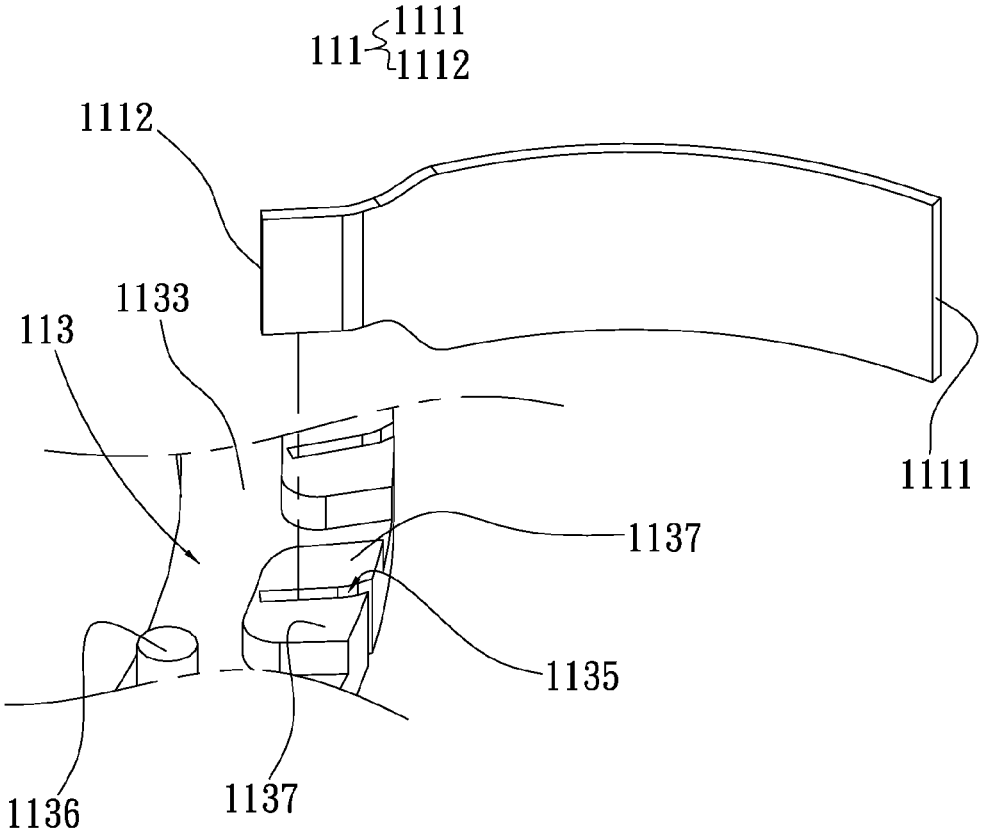
FIG. 6A is a perspective view showing that the rear end of the blade of the second embodiment is to be inserted in the insertion slit between the raised sections of the annular cover body.

Please refer to FIGS. 5A and 5B and also supplementally refer to FIG. 5C. FIG. 5A is a perspective exploded view of a second embodiment of the present invention. FIG. 5B is a perspective assembled view of the second embodiment of the present invention. FIG. 5C is a perspective view of the blade assembly of the second embodiment of the present invention, seen from another angle. In this embodiment, the fan impeller structure 1 includes a blade assembly 11 and a hub 15. The blade assembly 11 has multiple blades 111 and an annular cover body 113. The blades 111 can be made of metal material with ductility and malleability and good strength, such as, but not limited to, aluminum, aluminum alloy, steel, iron or titanium alloy material. Each blade 111 has a front end 1111 and a rear end 1112. The annular cover body 113 has multiple insertion slits 1135, multiple assembling sections 1136, multiple notches 1131, a top side 1132, a bottom side 1133 and multiple raised sections 1137. The insertion slits 1135 are formed on an outer circumference of the annular cover body 113. The rear ends 1112 of the blades 111 are inserted and connected in the insertion slits 1135 (as shown in FIGS. 5C and 6A).

Figure 6B:
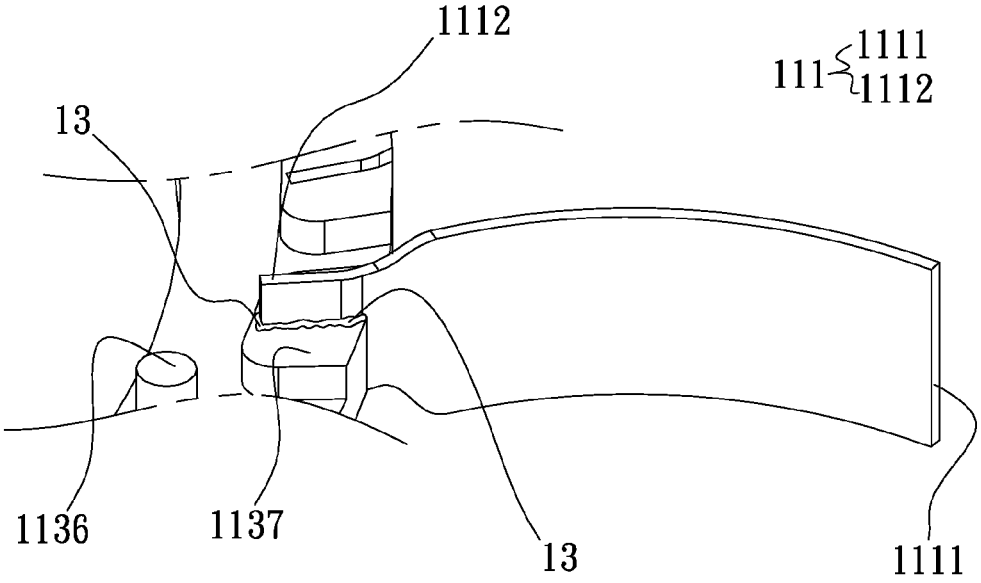
FIG. 6B is a perspective view showing that the rear end of the blade of the second embodiment is inserted in the insertion slit and integrally connected therewith by means of laser fusion.

At least one fusion section 13 is formed between the rear end 1112 of the blade 111 and a contact section of one side of the annular cover body 113 in adjacency to the insertion slit 1135. The fusion section 13 is connected between the rear end 1112 of the blade 111 and the side of the annular cover body 113 in adjacency to the insertion slit 1135. In this embodiment, the rear end 1112 of the blade 111 and the side of the annular cover body 113 in adjacency to the insertion slit 1135 are fused and connected with each other by means of laser processing (such as laser welding or so-called laser fusion) to form the fusion section 13 (as shown in FIGS. 5B and 6B). Accordingly, the annular cover body 113 is fused and integrally connected with the rear ends 1112 of the blades 111 to enhance the structural strength and connection strength between the annular cover body 113 and the blades 111.

The blades 111 are made of metal material by means of pressing. The blades 111 are ultrathin blades with a thickness preferably smaller than 0.15 mm. The hub 15 can be made of metal material by means of pressing. The annular cover body 113 can be also made of metal material by means of pressing. The notches 1131 are formed on the bottom side 1133 of the annular cover body 113 and arranged at intervals. The insertion slits 1135 are positioned between the notches 1131. The assembling sections 1136 are formed on one side of the annular cover body 113 in adjacency to the insertion slits 1135. In this embodiment, the assembling sections 1136 are formed on the bottom side 1133 of the annular cover body 113 along the inner circumference of the annular cover body 113 in alignment with the notches 1131. Each assembling section 1136 is a rivet column. In practice, the assembling section 1136 can be alternatively a bolt or a boss. The raised sections 1137 upward protrude from two sides of each adjacent insertion slit 1135. The raised sections 1137 are positioned between each two adjacent notches 1131.

Figure 7A:
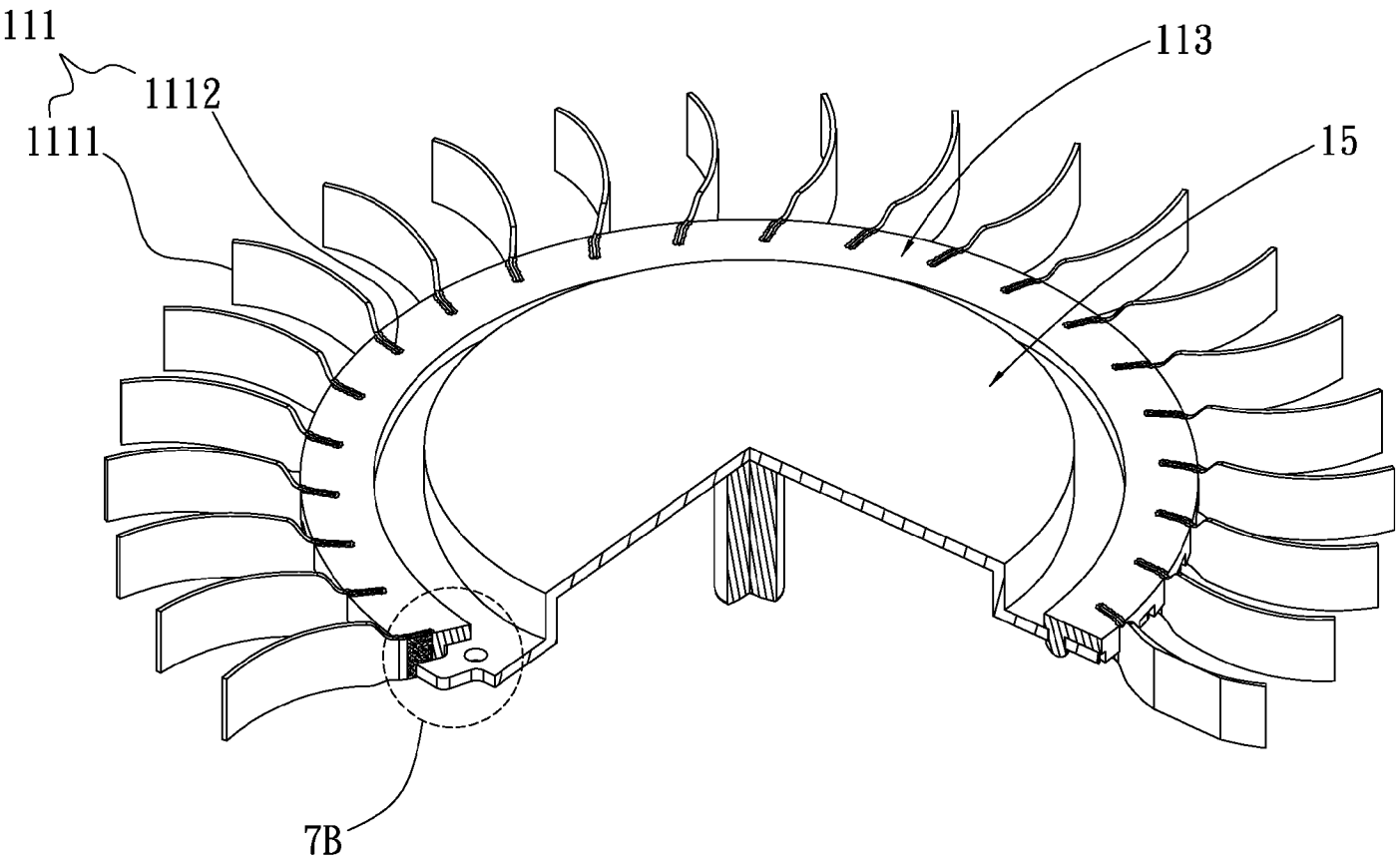
FIG. 7A is a perspective partially sectional view of the second embodiment of the fan impeller of the present invention.
Figure 7B:
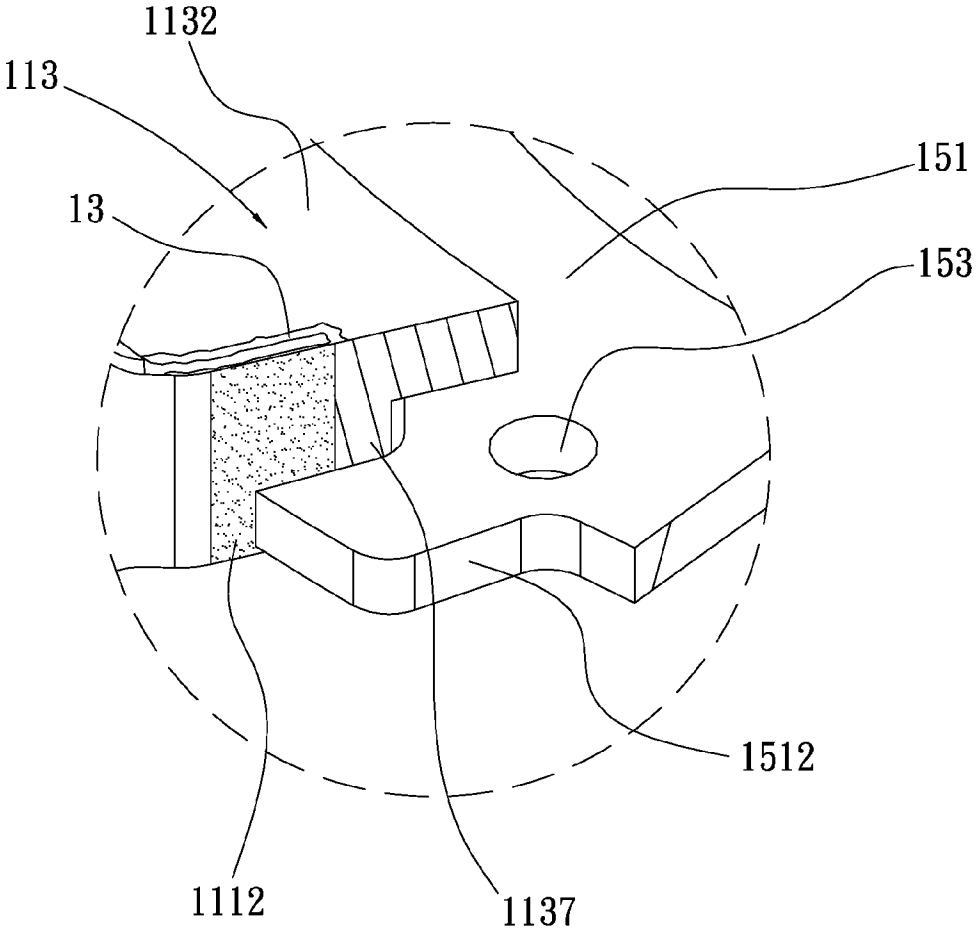
FIG. 7B is an enlarged view of circled area 7B of FIG. 7A.

In this embodiment, the hub 15 has a flange section 151, multiple perforations 153, a top wall 154 and a circumferential wall 155. These structures and the connection relationship of the second embodiment are substantially identical to the flange section 151, multiple perforations 153, top wall 154 and circumferential wall 155 of the hub 15 of the first embodiment and thus will not be repeatedly described hereinafter. In the second embodiment, the raised sections 1137 are received in the corresponding recesses 1511. In this embodiment, the perforations 153 are rivet holes. In practice, the perforations 153 can be alternatively threaded holes or insertion holes. The assembling sections 1136 are passed through the corresponding perforations 153 of the flange section 151 and then securely riveted on the flange section 151 by means of heat staking or cold staking (as shown in FIGS. 7A and 7B). Accordingly, the blade assembly 11 and the hub 15 are integrally connected with each other to form the fan impeller structure 1. In a modified embodiment, the assembling sections 1136 are connected in the perforations 153 by means of screwing (or connection) or press fit (or connection).

According to the above arrangement, the thinner blades 111 of the present invention are inserted and connected on the annular cover body 113. The annular cover body 113 is fused and integrally connected with the blades 111 by means of laser. Then the blade assembly 11 and the hub 15 are integrally connected with each other to form the fan impeller structure 1. The blades 111 are fixedly positioned around the hub 15 and the connection strength between the blades 111 and the hub 15 is enhanced. This improves the problem of the conventional fan impeller that the blades are directly welded on the hub or engaged with the hub and the connected parts are apt to break.

The present invention has been described with the above embodiments thereof and it is understood that many changes and modifications in the above embodiments can be carried out without departing from the scope and the spirit of the invention that is intended to be limited only by the appended claims.

What is claimed is:

1. A fan impeller structure of a cooling fan, comprising:

a blade assembly having multiple blades, each blade having a front end, a rear end, and at least one rear opening formed through the rear end of the blade and an annular cover body integrally formed on the rear ends of the blades by injection molding to enclose and connect with the rear ends of the blades, the annular cover body being formed with multiple assembling sections disposed on one side of the annular cover body and multiple enclosure sections integrally formed with the annular cover body on two sides of the rear ends of the blades and extending through the openings to enclose the rear ends of the blades; and a hub having a flange section, multiple perforations, a top wall, and a circumferential wall outward extending from a circumference of the top wall, the flange section outward extending from the circumferential wall, the flange section being correspondingly connected with the annular cover body, the perforations being formed through the flange section and integrally connected with the corresponding assembling sections.

2. The fan impeller structure of cooling fan as claimed in claim 1, wherein the annular cover body has multiple notches, a top side, and a bottom side, the notches being formed on the bottom side of the annular cover body and arranged at intervals, the rear ends of the blades being positioned between the notches, the assembling sections being formed on the bottom side of the annular cover body of the annular cover body along an inner circumference of the annular cover body in alignment with the notches.

3. The fan impeller structure of cooling fan as claimed in claim 2, wherein each enclosure section is positioned between each two adjacent notches.

4. The fan impeller structure of cooling fan as claimed in claim 3, wherein the flange section is formed with multiple recesses arranged along an outer circumference of the flange section, a protruding tooth being defined between each two adjacent recesses, the protruding teeth being inserted in the corresponding notches of the annular cover body, the enclosure sections being received in the recesses.

5. The fan impeller structure of cooling fan as claimed in claim 1, wherein the assembling sections are connected in the perforations by means of riveting, screwing or press fit.

6. A fan impeller structure of a cooling fan, comprising:

a blade assembly having multiple blades and an annular cover body, each blade having a front end and a rear end, the annular cover body having multiple insertion slits and multiple assembling sections, the insertion slits being formed on an outer circumference of the annular cover body, the rear ends of the blades being inserted and connected in the corresponding insertion slits, at least one fusion section being formed by fusing and connecting the rear end of each blade and a contact section of one side of the annular cover body in adjacency to a respective insertion slit by laser processing, the assembling sections being formed on one side of the annular cover body in adjacency to the insertion slits; and a hub having a flange section, multiple perforations, a top wall, and a circumferential wall outward extending from a circumference of the top wall, the flange section outward extending from the circumferential wall, the flange section being correspondingly connected with the annular cover body, the perforations being formed through the flange section and integrally connected with the corresponding assembling sections.

7. The fan impeller structure of cooling fan as claimed in claim 6, wherein the annular cover body has multiple notches, a top side, a bottom side, and multiple raised sections, the notches being formed on the bottom side of the annular cover body and arranged at intervals, the insertion slits being positioned between the notches, the assembling sections being formed on the bottom side of the annular cover body along an inner circumference of the annular cover body in alignment with the notches, the raised sections upward protruding from two sides of each adjacent insertion slit, the raised sections being positioned between each two adjacent notches.

8. The fan impeller structure of cooling fan as claimed in claim 7, wherein the flange section is formed with multiple recesses arranged along an outer circumference of the flange section, a protruding tooth being defined between each two adjacent recesses, the protruding teeth being inserted in the corresponding notches of the annular cover body, the raised sections being received in the corresponding recesses.

9. The fan impeller structure of cooling fan as claimed in claim 6, wherein the assembling sections are connected in the perforations by means of riveting, screwing or press fit.

* * * * *